United States Patent [19]

Bleger et al.

[11] Patent Number: 4,664,466

[45] Date of Patent: May 12, 1987

[54] ELECTRIC DEVICE WITH A CABLE SUPPORTING ELEMENT AND METHOD OF MOUNTING THE SUPPORTING ELEMENT TO THE ELECTRIC DEVICE

[75] Inventors: Claude Bleger, Duttlenheim, France; Peter Bruder, Ottersweier; Ernst Münster, Bühl-Vimbuch, both of Fed. Rep. of Germany

[73] Assignee: Robert Bosch GmbH, Stuttgart, Fed. Rep. of Germany

[21] Appl. No.: 753,676

[22] Filed: Jul. 10, 1985

[30] Foreign Application Priority Data

Sep. 7, 1984 [DE] Fed. Rep. of Germany ..... 3432856

[51] Int. Cl.[4] ..... H01R 13/506

[52] U.S. Cl. ..... 339/126 R; 339/206 R

[58] Field of Search ..... 339/126 R, 126 J, 126 RS, 339/127 R, 127 C, 132 R, 132 B, 206 R, 206 L, 206 P, 207 R, 207 S

[56] References Cited

U.S. PATENT DOCUMENTS

| | | | |
|---|---|---|---|
| 2,171,441 | 8/1939 | Barry | 339/126 R |
| 3,271,569 | 9/1966 | Eisenhardt | 339/126 R |
| 3,706,066 | 12/1972 | Shroyer | 339/126 R |
| 4,077,693 | 3/1978 | Briel, Jr. et al. | 339/126 R |
| 4,352,538 | 10/1982 | Fowler | 339/126 R |

*Primary Examiner*—Gil Weidenfeld
*Assistant Examiner*—Gary F. Paumen
*Attorney, Agent, or Firm*—Michael J. Striker

[57] ABSTRACT

In an electric device, a cable-supporting element for receiving an electric supply cable is formed of two disengagably-connectable portions, of which the first portion is formed with an extension inserted into a hole of a respective shape, formed in the cover of the housing of the electric device. The first portion is then displaced relative to that hole so that a projection formed on the extension, overlaps an inner edge of the recess and engages the latter. The second portion provided with a filling piece is then set onto the first portion so that the filling piece fills, together with the remaining part of the extension, the hole. The first and second portions are then locked to each other.

4 Claims, 10 Drawing Figures

ELECTRIC DEVICE WITH A CABLE SUPPORTING ELEMENT AND METHOD OF MOUNTING THE SUPPORTING ELEMENT TO THE ELECTRIC DEVICE

BACKGROUND OF THE INVENTION

The present invention relates to an electric device provided with a cable-receiving element which supports the end of an electric supply cable and holds it on the housing of the electric device.

Electric devices, having a housing provided with an open recess at the upper face of the housing or the cover of the housing, have been known. A support element for holding a supply cable is pressed from the edge into that recess and clamped therein so that a reliable fastening of the cable to the housing of the electric device is obtained. This solution is not, however practical when the housing must be closed all around.

SUMMARY OF THE INVENTION

It is an object of the present invention to provide an improved support element for mounting a supply cable to an electric device.

It is another object of the present invention to provide an improved method of mounting a support element for holding a supply cable to the housing of the electric device, which is to be closed all around and can not be provided with a perforation.

These and other objects of this invention are attained by an electric device including a housing having an open recess and at least one electric supply cable; and a support element mounted to said housing to receive and support an end of said cable, the support element including a first portion and a second portion mounted in said housing so that a region of separation between said first and second portion is positioned in said recess, said first portion having a bottom surface and being formed with a base portion extended outwardly from said bottom surface, said base portion having a cross-section area which is smaller than that of said bottom surface, said base portion being inserted into said recess and having a height greater than the thickness of a housing wall having said recess, said base portion having an undercut which forms on said base portion a projection and a neck portion, said projection being spaced from said bottom surface by a distance which corresponds to the thickness of said wall and to the height of said undercut, said second portion of the support element being mounted to said first portion and being formed with a filling piece which together with said neck portion fills said recess in assembly, said projection overlapping an inner edge of said recess in assembly.

The base portion may include at least two opposing stops extended transversely of said projection, said stops being spaced from said bottom surface by a distance which corresponds to the thickness of said wall, said open recess having two opposite lateral portions which receive said stops upon the insertion of said base portion into said recess, said lateral portions being spaced from an edge of said recess, facing said neck portion in assembly, by a distance which corresponds to a distance from a free end of said projection to said stops.

The support element may further include locking means for locking said first portion and said second portion to each other in assembly.

The first portion may be formed as a plug socket and having an opening for a plug tongue; the device may further include a connection element rigidly mounted in said housing and electrically connected to the plug tongue.

The device may further include a connection element rigidly mounted in the housing and extended into the support element, said connection element being connected to said cable, said first portion and said second portion in said region of separation forming a through guide means for said cable.

The first portion and the second portion may be made of elastic plastics.

The objects of the present invention are also attained by a method comprising the steps of inserting said base portion of said first portion into said recess in a vertical direction, displacing said first portion relative to said recess in a direction transversal to said vertical direction so that said projection becomes engaged with and overlaps an inner edge of recess, mounting said second portion to said first portion so that said filling piece is inserted into a space in said recess, formed, due to said displacement, between an edge of said base portion, facing away from said projection, and an edge of said recess, and locking said first portion and said second portion to each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
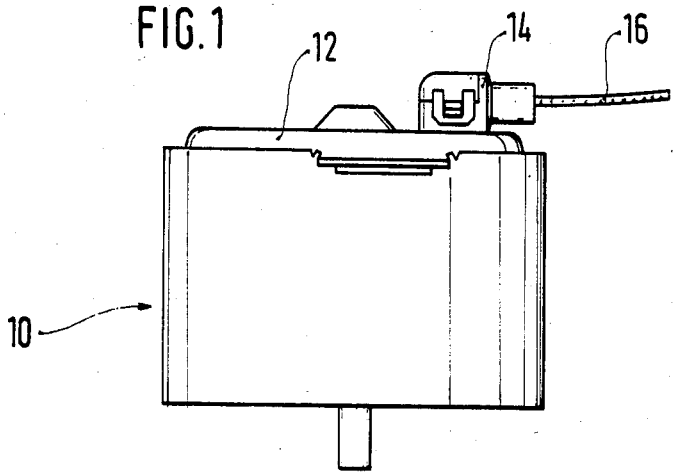
FIG. 1 is a side view of an electric motor with an electric supply cable and a support element for the cable.

Referring now to the drawings in detail, FIG. 1 shows a side view of an electric motor 10 which represents an electric device. Electric motor 10 has a housing which is closed at an end face thereof with a bearing cover 12. A support element 14, in which a supply cable 16 for electric motor 10 is supported, is connected to the bearing cover 12.

FIGS. 2 through 5 illustrate the construction of the cable support or support element 14 and the manner of its fastening to the housing of the electric motor.

Figure 2:
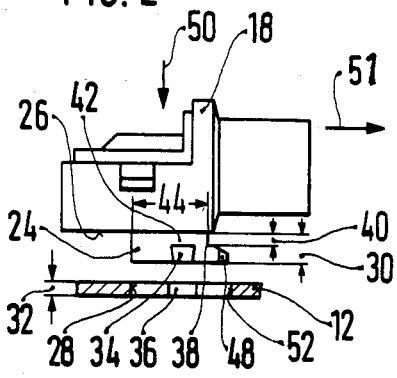
FIG. 2 is a side view, partially in section, of the cover of the electric motor housing and a portion of the support element removed from the motor housing.
Figure 3:
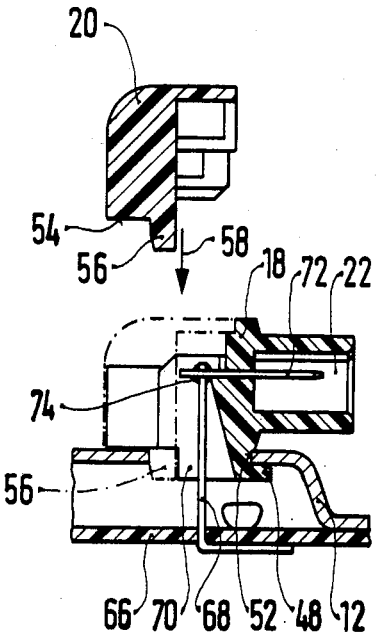
FIG. 3 illustrates in section two portions of the support element, of which one portion is in the inserted position in the cover of the electric motor and the other portion is to be assembled.

As specifically seen from FIG. 3 the support element 14 is comprised of two portions 18 and 20. Portion 18 is formed as a plug socket which has an insertion recess 22 into which a plug with a supply cable 16 is insertable. As shown in FIG. 2 plug socket 18 of the support element 14 has a base portion 24 which is provided as an extension on a bottom surface 26 of the plug socket or portion 18. The bottom surface of portion 18 is greater than the surface of the base portion 24 connected thereto so that bottom surface 26 forms an abutment shoulder. Thus the support element 14 can be connected to the bearing cover 12 provided with a recess 28, into which base portion 24 is insertable. The height 30 of the base portion or extension 24 is greater than the thickness 32 of the cover 12.

Figure 2A:
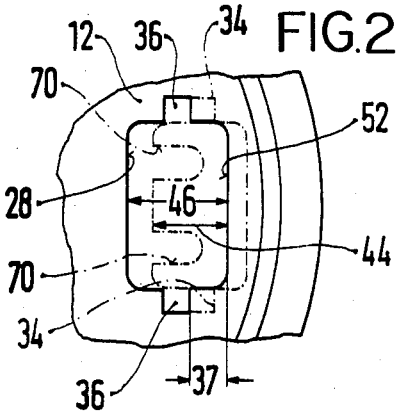
FIG. 2*a* is a portion of the top plan view of the cover of the electric motor housing.
Figure 4:
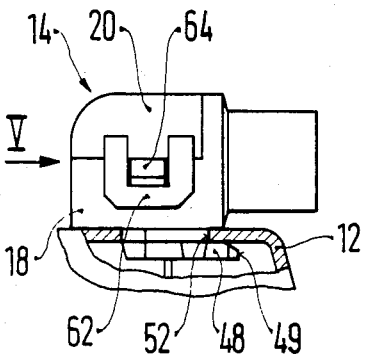
FIG. 4 shows two portions of the support element of FIG. 3 in the assembled condition.
Figure 5:
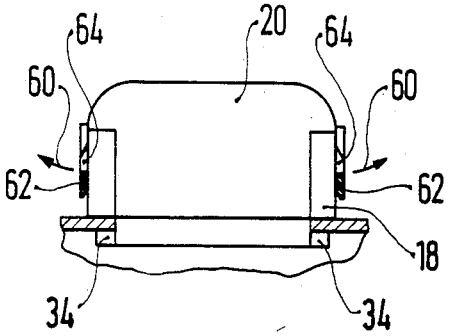
FIG. 5 is a view seen from arrow V of FIG. 4.

The shape of recess 28, as clearly seen in FIG. 2*a*, is formed such that base portion 24 of plug socket 18 extends through this recess into the interior of the housing of electric motor 10. Two stops 34 (FIG. 5), which are positioned opposite one another, are provided on the portion 18. Through recesses 36 formed in the recess 28, respectively, correspond to the stops 34. The distance 37 (FIG. 2*a*) between the edges of through recesses 36 and the edge of recess 28, facing toward a neck portion 42 of the extension or base portion 24 corresponds to the distance between a free end edge 49 of a projection 48, provided on the base portion 24, and the stops 34. Base portion 24 further has an undercut 38, the height of which is defined by a distance 40 from the bottom surface 26. Distance 40 corresponds to the thickness 32 of the housing cover 12. Thereby neck portion 42 of the base portion or extension 24 has the height equal to distance 40. The width 44 of the neck portion 42 is smaller than the width 46 of the recess 28. Thus projection 48 of the base portion 24 is spaced by distance 40 from the bottom surface 26. Stops 34 are also spaced by distance 40 from the surface 26. Portion 18 of the two-part support element 14 can be inserted into recess 28 of cover 12 in the direction of arrow 50 (FIG. 2), whereby the base portion 24 extends through the recess 28 and stops 34 extend through recesses 36. When bottom surface 26 of the portion 18 of the support element 14 comes into contact with the upper face of cover 12 the entire portion 18 is displaced in the direction of arrow 51 so that portion 18 takes a position illustrated in FIG. 3. In this position projection 48, formed by undercut 38, overlaps an inner edge 52 of the recess 28. Stops 34 of the base 24 will eventually overlap lateral inner edges of recess 28 as shown by dash-dotted lines in FIG. 2*a* and in FIG. 5. Both portions 18 and 20 are formed of resilient plastics.

In the assembled position of portion 18 of the support element 14, shown in FIG. 3, portion 18 is locked against being disengaged from recess 28 in the direction counter to arrow 50. In order to reliably anchor portion 18 in recess 28 of the housing cover 12 a second portion 20 of the support element 14 is mounted to portion 18. This second portion 20 has on the underside thereof a filling piece or projection 56, the dimensions of which are selected so that they correspond to the amount of the displacement in the direction of arrow 51, by which amount the portion 18 of support element 14 is moved in the direction of arrow 51 in the recess 28 after being inserted into that recess. Then the filling piece 56 of the second portion 20, which is moved in the direction of arrow 58, is inserted into recess 28, which results in the assembled position shown in FIG. 4. Recess 28 of the cover 12 is filled in this position with the filling piece 56 and the neck portion 42 of the extension 24. In order to secure portions 18 and 20 to each other portion 20 is provided with two opposing U-shaped tongues 62 elastically deflectable in the direction of arrows 60. These locking tongues cooperate with counter locking cam portions 64 provided on portion 18 of the support element 14 whereby the disengagement of portions 18 and 20 in the direction counter to arrow 58 is impossible.

As particularly shown in FIG. 3, the support element 14 of the above described embodiment is formed as a plug socket and serves for guiding a conductor leading from a current supply source, for example to the commutator of the electric motor 10. In this embodiment a connection angle 68 electrically oonnected to the commutator of the electric motor is secured to a brush-carrying plate 66. The vertical leg of the connection angle 68 extends through plate 66 and through recess 28 of cover 12 outwardly into a groove 70 formed in the portion 18 of the support element 14. The free end of the vertical leg of angle 68 is positioned in the region of a plug tongue 72 which extends through the plug recess 22 of portion 18 of support element 14. The free end of the vertical leg of angle 68 is connected to the plug tongue 72 by a soldering joint 74. A conventional plug of electric cable 16 can be now brought into recess 22 so that cable 16 would be supported in element 14.

As can be seen from FIG. 2*a* two supply cables can be received and supported in the support element 14 of this embodiment because two grooves or recesses 70 for passing two connection angles 68 therethrough are provided in portion 18 of the support element.

Figure 6:
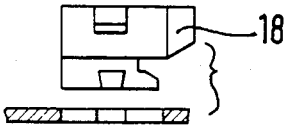
FIG. 6 is a partial sectional view of the cover of the electric motor with a support element removed therefrom, according to another embodiment.
Figure 7:
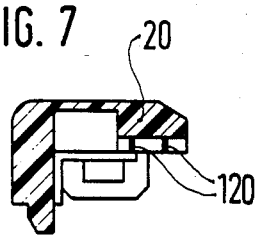
FIG. 7 is a sectional view of two portions of the support element of FIG. 6, of which one portion is inserted into the housing of the electric motor and the other portion is positioned before its assembling to the one portion of the support element.
Figure 6A:
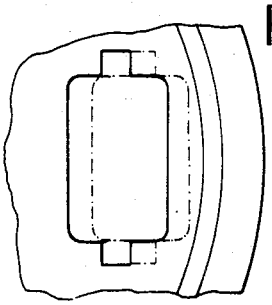
FIG 6*a* is a top plan view of the portion of the cover.
Figure 6A:
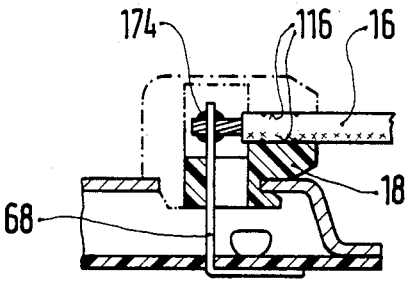
Figure 8:
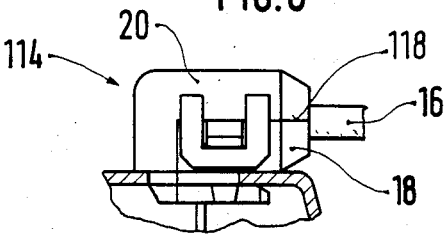
FIG. 8 is a side view of the assembled support element of the embodiment of FIGS. 6–7.

In the embodiment of FIGS. 6–8 structural components, identical to those of FIGS. 1–5, are denoted by the same reference numerals. The embodiment of FIGS. 6–8 is distinguished from that of FIGS. 1–5 in that the modified embodiment is formed as a cable traction relief. The support element 114, shown in FIG. 7 in the assembled position, has, in place of the plug-receiving recess 22 and plug tongue 72, a cable guide 116, which is positioned in the region of a separating plane 118 between portions 18 and 20 of the support element 114. The end of the electric supply cable 16 is positioned in the cable guide 116 and is connected by a soldering joint 174 to the upper end of the connection angle 68. The guide 116 has a clamping crosspiece 120 which can engage in the insulation of cable 16 when portions 18 and 20 of support element 114 are locked to each other in the above described fashion.

The method of assembly of support element 14 appears to be clear from FIGS. 2–5. The individual assembly steps of the support element 114 are identical to those for support element 14. Portion 18 of the support element 14 is first placed against the recess 28 of cover 12. This position is shown in FIG. 2. Then portion 18 is inserted into recess 28 and is pressed therethrough at the base portion 24 in the direction of arrow 50. Thereafter portion 18 is displaced by a user in the direction of arrow 52 unless the neck portion 42 abuts against the inner edge 52 of the recess 28. In this position projection 48 of portion 18 overlaps the inner edge 52 of recess 28. The stops 34 in this position are displaced relative to recesses 36, as shown by dash-dotted lines in FIG. 2*a*, and the portion 18 of support element 14 is locked against being pulled out in the direction counter to the direction of arrow 50. Upon the displacement of portion 20 in the direction of arrow 58 (FIG. 3) the filling piece 56 of portion 20 locks portion 18 against displacement. Thereby both portions 18 and 20 are connected to each other by locking and counterlocking means 62 and 64, and an inadvertent removal of support element 14 from recess 28 is impossible. The support element 14 can be removed from bearing cover 12 only when, first, the lock between the portions 18 and 20 is released and portion 20 is moved in the direction against arrow 58. Then portion 18 can be displaced in the direction opposite to that of arrow 51 unless stops 34 are positioned against recesses 36 and projection 48 is positioned in the region of recess 28. Portion 18 can then be removed from the opening of the housing of the electric motor. It is, of course understood that the solder joint 74 between the plug tongue 72 and angle 68 should be preliminarily disconnected.

It seems to be clear that the extension or base portion 24 as well as the filling piece 56 should be formed as plug-shaped members. Wall means are provided on portions 18 and 20, which cooperate with recess 18 in the above-described manner.

It will be understood that each of the elements described above, or two or more together, may also find a useful application in other types of electric devices with cable-receiving supporting elements differing from the types described above.

While the invention has been illustrated and described as embodied in an electric device with a cable-receiving supporting element, it is not intended to be limited to the details shown, since various modifications and structural changes may be made without departing in any way from the spirit of the present invention.

Without further analysis, the foregoing will so fully reveal the gist of the present invention that others can, by applying curent knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrice device including a housing having an open recess and at least one electric supply cable; a support element mounted to said housing to receive and support an end of said cable, the support element including a first portion and a second portion lockingly connectable to said first portion and mounted in said housing so that a region of separation between said first and second portion is located in said recess, said first portion having a bottom surface and being formed with a base portion extended outwardly from said bottom surface, said base portion having a cross-section area which is smaller than that of said bottom surface, said base portion being inserted into said recess and having a height greater than the thickness of a housing wall having said recess, said base portion having an undercut which forms on said base portion a projection and a neck portion, said projection being spaced from said bottom surface by a distance which corresponds to the thickness of said wall and to the height of said undercut, said second portion of the support element being mounted to said first portion and being formed with a filling piece which together with said neck portion fills said recess when said second portion is mounted onto said first portion, said projection overlapping an inner edge of said recess in assembly; and an electrical connection element rigidly mounted in said housing and extended into the support element, said electrical connection element being electrically connected to said cable, said first portion and said second portion forming a through guide for receiving an end of said cable and said electrical connection element such that an electrical connection between said connection element and said cable is protected within said first and second portion and the end of said cable is clamped in said through guide.

2. The electric device as defined in claim 1, wherein said base portion includes at least two opposing stops extended transversely of said projection, said stops being spaced from said bottom surface by a distance which corresponds to the thickness of said wall, said open recess having two opposite laterial portions which receive said stops upon the insertion of said base portion into said recess, said lateral portions being spaced from an edge of said recess by a distance which corresponds to a distance from a free end of said projection to said stops.

3. The electric device as defined in claim 2, said support element further including locking means for locking said first portion and said second portion to each other when said second portion is mounted on said first portion.

4. The electric device as defined in claim 1, wherein said first portion and said second portion are made of elastic plastics.

* * * * *